US011622593B2

(12) United States Patent
Donovan

(10) Patent No.: US 11,622,593 B2
(45) Date of Patent: Apr. 11, 2023

(54) SHOE COMPRISING INTERCHANGEABLE OUTSOLE

(71) Applicant: Ryan Donovan, Glendale, AZ (US)

(72) Inventor: Ryan Donovan, Glendale, AZ (US)

( * ) Notice: Subject to any disclaimer, the term of this patent is extended or adjusted under 35 U.S.C. 154(b) by 28 days.

(21) Appl. No.: 17/307,782

(22) Filed: May 4, 2021

(65) Prior Publication Data

US 2021/0345724 A1 Nov. 11, 2021

Related U.S. Application Data

(60) Provisional application No. 63/020,726, filed on May 6, 2020.

(51) Int. Cl.
*A43B 21/42* (2006.01)
*A43B 3/24* (2006.01)
*A43B 21/51* (2006.01)

(52) U.S. Cl.
CPC ..... *A43B 3/246* (2013.01); *A43B 3/244* (2013.01); *A43B 21/42* (2013.01); *A43B 21/51* (2013.01)

(58) Field of Classification Search
CPC ..... A43B 21/36; A43B 21/38; A43B 21/42; A43B 21/433; A43B 21/44; A43B 21/50; A43B 21/51
USPC ..... 36/36 C, 36 R, 41, 42
See application file for complete search history.

(56) References Cited

U.S. PATENT DOCUMENTS 2,299,840 A * 10/1942 Merritt ..... A43B 13/37 36/108
2,943,404 A * 7/1960 Sultan ..... A43B 21/50 36/42
4,146,981 A * 4/1979 Renaldo ..... A43B 3/24 36/15
4,494,323 A * 1/1985 Latraverse ..... A43B 13/34 36/24.5
4,805,320 A 2/1989 Goldenberg et al.
8,112,908 B2 2/2012 Visser
9,215,909 B2 12/2015 Saccullo et al.
9,486,032 B2 11/2016 Morris Thill
2013/0062231 A1* 3/2013 Angiulo ..... A43B 3/246 206/278

(Continued)

FOREIGN PATENT DOCUMENTS

EP 3466292 A1 * 4/2019 ..... A43B 13/14
WO WO-2009141844 A1 * 11/2009 ..... A43B 13/16
WO 2015142518 9/2015

OTHER PUBLICATIONS

FR 3000875, published Jul. 2014 (Leslie), with translation.*

(Continued)

*Primary Examiner* — Ted Kavanaugh

(74) *Attorney, Agent, or Firm* — Snell & Wilmer L.L.P.

(57) ABSTRACT

A shoe having one or more detachable and/or interchangeable outsoles is provided herein. The shoe may include a sole, a rear outsole (e.g., a stiletto, a wedge, etc.), and a forward outsole (e.g., a platform, etc.). The sole may be generally configured to support a wearer's foot, with the rear outsole being detachably coupled to a rear portion of the sole and the forward outsole being detachably coupled to a forward portion of the sole. By having two detachable outsoles (e.g., a detachable rear outsole and a detachable forward outsole), the shape, style, and design of the shoe can be varied/changed.

10 Claims, 9 Drawing Sheets

(56) References Cited

U.S. PATENT DOCUMENTS

| | | | | |
|---|---|---|---|---|
| 2013/0067770 | A1* | 3/2013 | Sherwood | A43B 21/39<br>36/100 |
| 2013/0312285 | A1 | 11/2013 | Sharma et al. | |
| 2015/0135552 | A1 | 5/2015 | Morell | |
| 2019/0014860 | A1* | 1/2019 | Pavone | A43B 13/37 |

OTHER PUBLICATIONS

Manabis, "About us // detachable sole—Mahabis Slippers—footwear for time well spent" dated May 5, 2021, https://mahabis.com/pages/about-detachable-sole, 6 pages.

* cited by examiner

SHOE COMPRISING INTERCHANGEABLE OUTSOLE

CROSS-REFERENCE TO RELATED APPLICATIONS

This application claims priority to and the benefit of U.S. Patent Application No. 63/020,726 entitled SHOE COMPRISING INTERCHANGEABLE OUTSOLE filed May 6, 2020, the entire contents of which is incorporated by reference herein.

FIELD

This application relates to footwear, and more particularly to shoes having interchangeable outsoles.

BACKGROUND

Conventional shoes typically have a shape, style, and design that are fixed and unchangeable. For example, conventional high-heel shoes have a heel height that is fixed, and conventional wedge shoes have an outsole with a specific shape/height. The fixed configuration of conventional shoes prevents wearers from customizing, changing, replacing, swapping, or otherwise altering the shape, style, and design of soles/outsoles of their shoes. Although there are various shoes that have a detachable heel configuration, these solutions have various deficiencies, limitations, inadequacies, and/or other shortcomings.

SUMMARY

The subject matter of the present disclosure has been developed in response to the present state of the art, and in particular, in response to the problems and needs in the art that have not yet been fully solved by currently available shoes. Accordingly, the present disclosure has been developed to provide a shoe that overcomes many or all of the above-discussed shortcomings in the art, in accordance with various embodiments.

Disclosed herein, according to various embodiments, is a shoe that includes a sole, a rear outsole (e.g., a stiletto, a wedge, etc.), and a forward outsole (e.g., a platform, etc.). The sole may be generally configured to support a wearer's foot, with the rear outsole being detachably coupled to a rear portion of the sole and the forward outsole being detachably coupled to a forward portion of the sole. By having two detachable outsoles (e.g., a detachable rear outsole and a detachable forward outsole, also described herein as a detachable heel outsole and detachable toe outsole), the shape, style, and design of the shoe can be varied/changed. Additional details pertaining to a shoe having two detachable outsoles are included in the detailed description section below.

In various embodiments, the rear portion of the sole is a heel portion of the sole and the forward portion of the sole is a toe portion of the sole. The rear outsole may be configured to be detached independent of the forward outsole, and/or vice-versa. In various embodiments, the rear outsole is configured to engage the forward outsole. For example, an engagement between the rear outsole and the forward outsole may comprise an interlocking interface. In various embodiments, the rear outsole comprises one of a protrusion and a corresponding groove and the forward outsole comprises the other of the protrusion and the corresponding groove. In various embodiments, the interlocking interface between the protrusion and the corresponding groove is configured to limit substantial movement between the rear outsole and the forward outsole to relative sliding motion along an axis of the interlocking interface.

In various embodiments, the shoe further comprises a rear attachment mechanism configured to enable reversible securement of the rear outsole to the rear portion of the sole and a forward attachment mechanism configured to enable reversible securement of the forward outsole to the forward portion of the sole. Each of the rear attachment mechanism and the forward attachment mechanism may be configured to be actuated between a locked state and released state. In various embodiments, the rear attachment mechanism is configured to be actuated independent of the forward attachment mechanism. In various embodiments, the rear attachment mechanism comprises a shaft rotatably housed and supported in one of the rear outsole and the rear portion of the sole, wherein the shaft comprises a flange section configured to engage the other of the rear outsole and the rear portion of the sole in the locked state. In various embodiments, the other of the rear outsole and the rear portion of the sole defines a chamber, wherein in the locked state the flange section of the shaft is disposed in the chamber to retain the rear outsole connected to the rear portion of the sole. In various embodiments, in the released state the shaft is rotated such that the flange section is not disposed in the chamber, thus allowing detachment of the rear outsole from the rear portion of the sole.

Also disclosed herein, according to various embodiments, is a a shoe comprising a sole configured to support a wearer's foot, an outsole, and an attachment mechanism integrated with one of the sole and the outsole. The attachment mechanism may be configured to enable reversible securement of the outsole to the sole. In various embodiments, the attachment mechanism comprises a shaft rotatably housed and supported in one of the outsole and the sole, wherein the shaft comprises a flange section configured to engage the other of the outsole and the sole in a locked state. In various embodiments, the other of the outsole and the sole defines a chamber, wherein in the locked state the flange section of the shaft is disposed in the chamber to retain the outsole connected to the sole. In various embodiments, in a released state the shaft is rotated such that the flange section is not disposed in the chamber, thus allowing detachment of the outsole from the sole. In various embodiments, a tip of the shaft comprises a key feature, wherein an actuation key 111 is configured to engage the key feature to rotate the shaft to switch between the locked state and the released state. In various embodiments, the tip of the shaft is accessible by the actuation key 111 from above a top surface of a rear portion of the sole. Additional details pertaining to a shoe having an attachment mechanism are included in the detailed description section below.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Thus, although the subject matter of the present disclosure is particularly pointed out and distinctly claimed in the concluding portion of the specification, a more complete understanding of the present disclosure, may best be obtained by referring to the detailed description and claims when considered in connection with the drawing figures. Understanding that these drawings depict only typical embodiments of the disclosure and are not therefore to be considered to be limiting of its scope, the subject matter of the present application will be described and explained with additional specificity and detail through the use of the accompanying drawings, in which:

DETAILED DESCRIPTION

Figure 1:
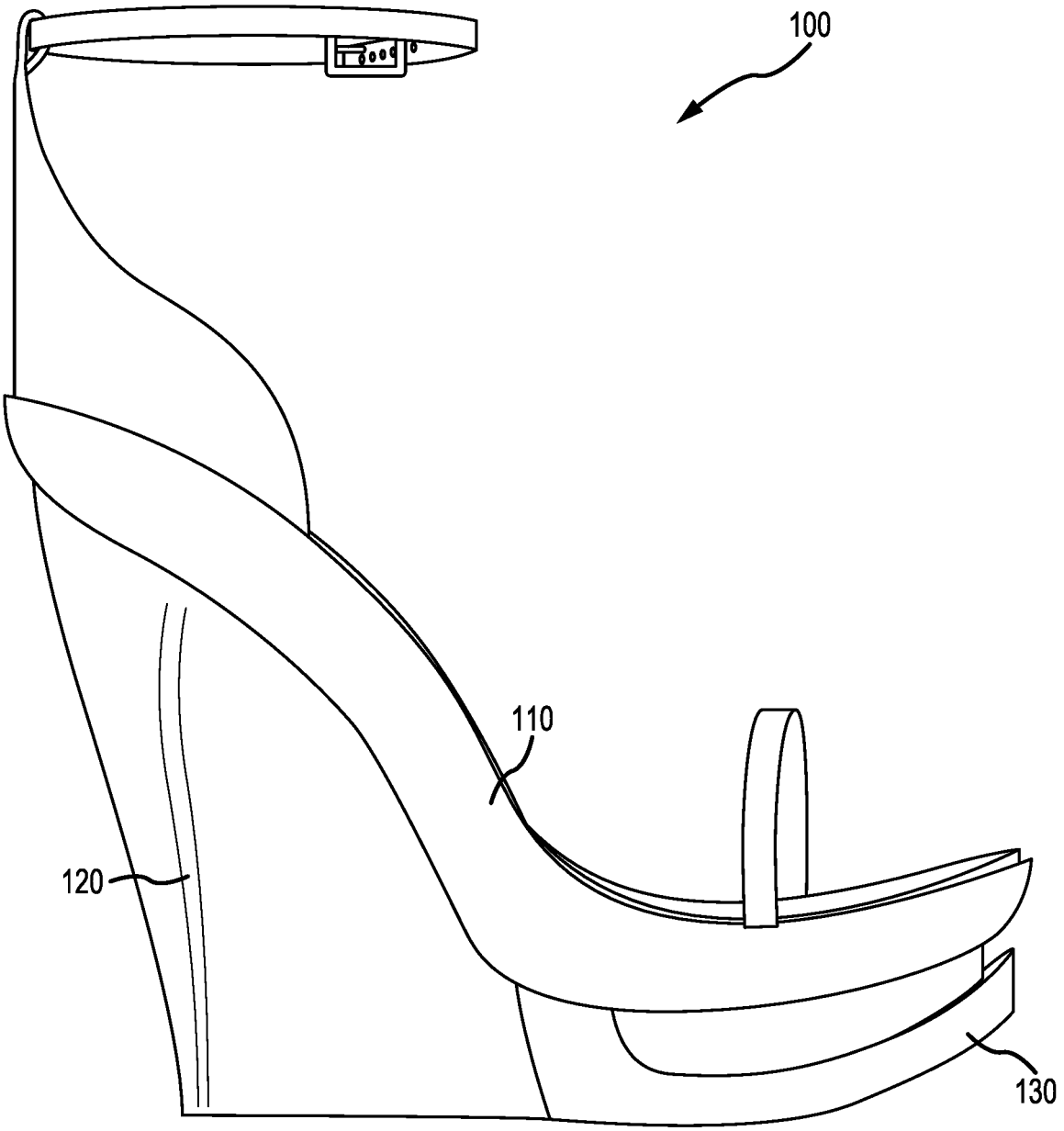
FIG. 1 is a perspective view of a shoe having a rear outsole and a forward outsole that are detachable from a sole of the shoe, in accordance with various embodiments.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

As used herein, the terms "including," "comprising," "having," and variations thereof mean "including but not limited to" unless expressly specified otherwise. Accordingly, the terms "including," "comprising," "having," and variations thereof are intended to cover a non-exclusive inclusion, such that a process, method, article, or apparatus that comprises a list of elements does not include only those elements but may include other elements not expressly listed or inherent to such process, method, article, or apparatus. An enumerated listing of items does not imply that any or all of the items are mutually exclusive and/or mutually inclusive, unless expressly specified otherwise.

Further, in the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Thus, when a particular feature, structure, or characteristic is described in connection with an embodiment, it is submitted that it is within the knowledge of one skilled in the art to affect such feature, structure, or characteristic in connection with other embodiments whether or not explicitly described. Similarly, the use of the term "implementation" means an implementation having a particular feature, structure, or characteristic described in connection with one or more embodiments of the present disclosure. Absent an express correlation to indicate otherwise, an implementation may be associated with one or more embodiments. After reading the description, it will be apparent to one skilled in the relevant art(s) how to implement the disclosure in alternative embodiments.

Disclosed herein, according to various embodiments, is a shoe having one or more detachable outsoles. Although numerous details and examples are included herein pertaining to high-heel shoes (e.g., stilettos) and wedge shoes, the present disclosure is not necessarily so limited, and thus aspects of the disclosed embodiments may be adapted for performance in other types of shoes. For example, the present disclosure may be implemented in any footwear including, but not limited to, formal shoes, dress shoes, heels, sports/athletic shoes (e.g., tennis shoes, golf shoes, bowling shoes, running shoes, basketball shoes, soccer shoes, ballet shoes, etc.), walking shoes, sandals, flip-flops, boots, high-top style shoes/boots, or other types of shoes. Further, the shoes disclosed herein may be used by adults or children. As such, numerous applications of the present disclosure may be realized.

Figure 2:
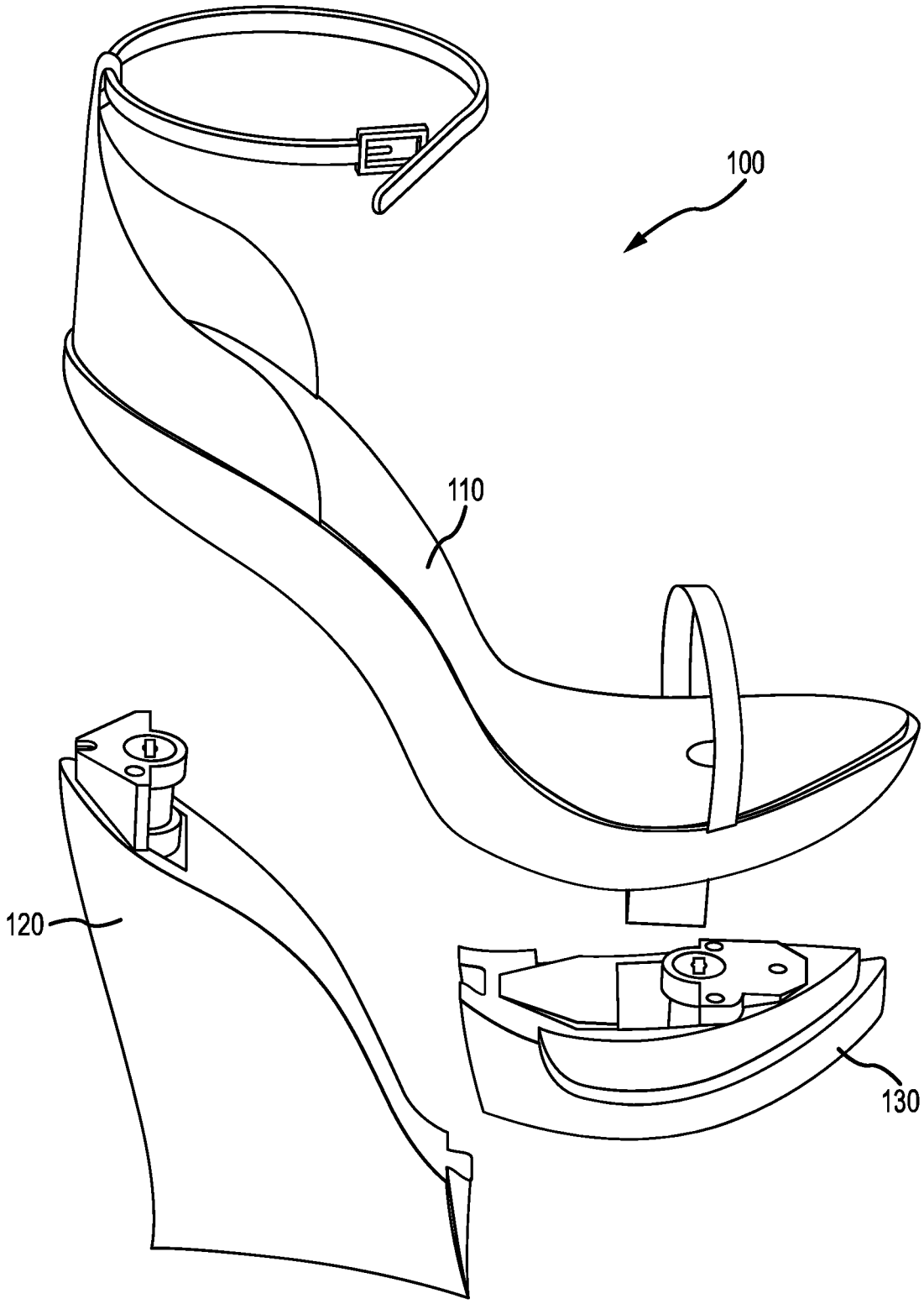
FIG. 2 is a perspective view of the shoe of FIG. 1 showing both the rear outsole and the forward outsole detached from the sole of the shoe, in accordance with various embodiments.

In various embodiments, and with reference to FIGS. 1 and 2, a shoe 100 includes a sole 110, a rear outsole 120, and a forward outsole 130. The sole 110, which may be a midsole, is configured to support a wearer's foot and may generally be referred to as the base of the shoe 100. The two outsoles 120, 130 are detachably coupled to the sole 110, according to various embodiments. For example, the rear outsole 120 (e.g., a stiletto or a wedge) may be detachably/reversibly coupled to a rear portion (e.g., a heel portion) of the sole 110 and the forward outsole 130 (e.g., a platform) may be detachably/reversibly coupled to a forward portion (e.g., a toe portion) of the sole 110. The structure and mechanism that may be employed to enable the detachable connection between the outsole(s) and the sole are described in greater detail below with reference to FIGS. 4A, 4B, 4C, 5, 6A, 6B, and 7.

Figure 3:
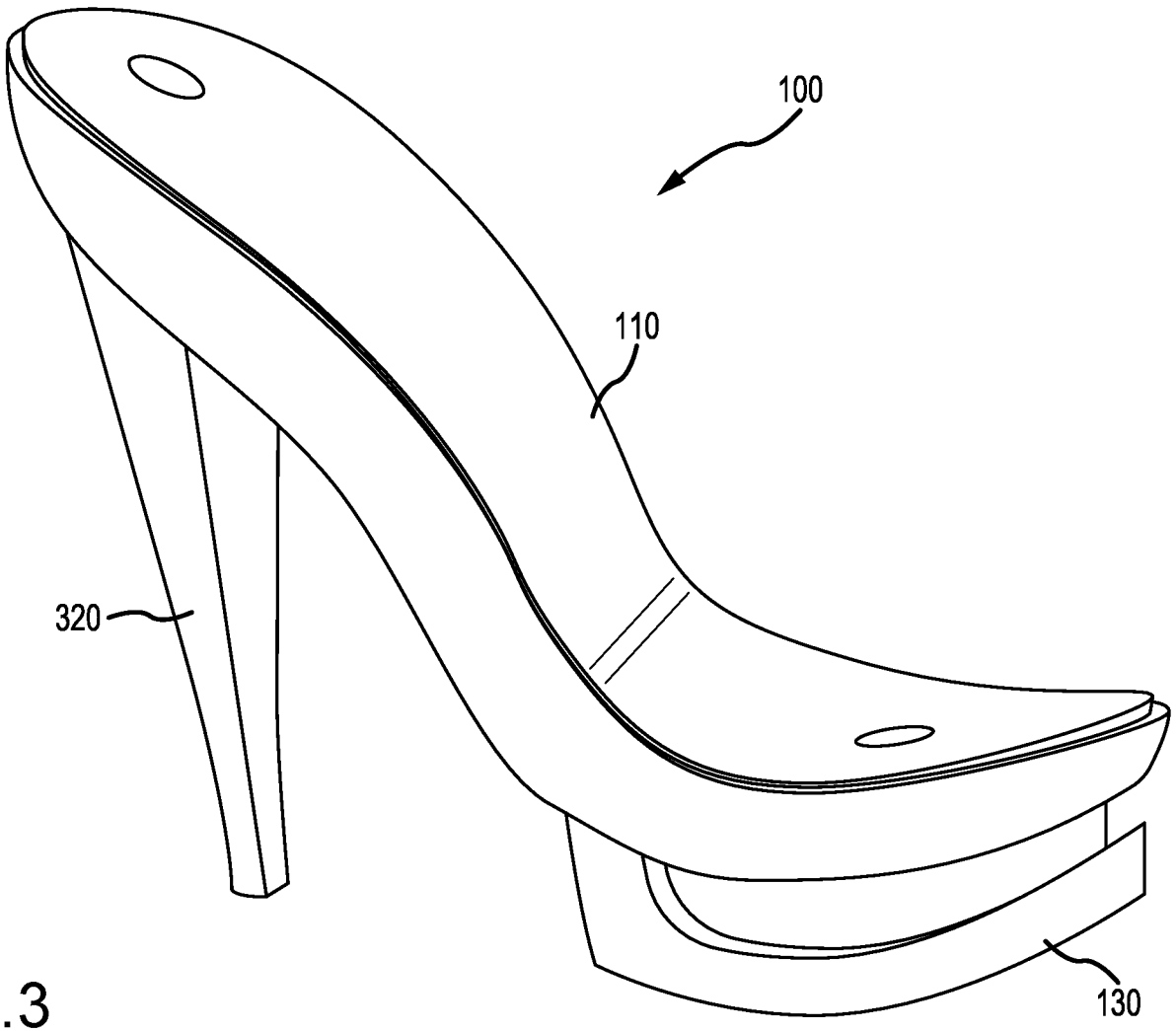
FIG. 3 is a perspective view of the shoe of FIG. 1 showing an alternative rear outsole in place of the original rear outsole, in accordance with various embodiments.

By configuring the outsoles 120, 130 to be detached from the sole 110, the user/wearer is able to alter the shape, style, and/or design of the shoe 100. For example, the wearer may swap out one or both of the outsoles 120, 130. Accordingly, the rear outsole 120, which may be a wedge-type heel, may be replaced with a different style, such as a stiletto heel 320 (FIG. 3). In various embodiments, the two outsoles 120, 130 are configured to be separately and independently detached. For example, the rear outsole 120 may be detached independent of the forward outsole 130, and vice-versa. In various embodiments, the shoe 100 having two detachable outsoles provides greater design and optimization flexibility to the wearer than a shoe with no detachable outsole portions, or a shoe with a single detachable outsole portion. For example, replacing a heel outsole portion may cause the toe portion to have an improper orientation relative to the ground during walking/running. Thus, allowing for both outsole portions to be interchangeable enables the wearer to optimize not only the shape, style, and design of the shoe, but also the comfort, performance, and gait-response of the shoe, according to various embodiments.

In various embodiments, the two outsoles 120, 130 are configured to engage each other. For example, the two outsoles 120, 130 may directly contact each other below the footbed of the shoe (e.g., FIGS. 1 and 2). In such embodiments, this direct contact between two independently detachable outsole portions improves stabilization of the shoe. In various embodiments, the rear outsole 120 is configured to engage the forward outsole 130 at an engagement interface. The engagement interface, may be an interlocking interface. That is, instead of merely being in contact with each other, the two outsoles 120, 130 may interlock with each other, thus further imparting stabilization to the shoe 100. In various embodiments, the interlocking interface between the two outsoles is configured to limit substantial movement between the rear outsole and forward outsole to relative sliding motion along an axis of the interlocking interface. Said differently, relative motion between the two outsoles 120, 130 may be limited to a single direction, thus enabling sliding of one relative to the other in response to one of the outsoles being detached from the sole. In various embodiments, the axis of relative movement (e.g., the 'sliding' axis) extends through the sole 110 of the shoe.

In various embodiments, the interlocking interface includes a protrusion and a corresponding groove. That is, the rear outsole 120 may have either a protrusion or a corresponding groove and the forward outsole 130 may have the other of the protrusion and the corresponding groove. The protrusion may be configured to be inserted into the corresponding groove and slide along/through the groove, thus providing the limited relative movement discussed above (e.g., along the interlocking interface). In various embodiments, other features, shapes, configurations, and/or components may be utilized at the engagement interface between the two outsoles 120, 130 to provide the stabilization benefits described herein.

Figure 4A:
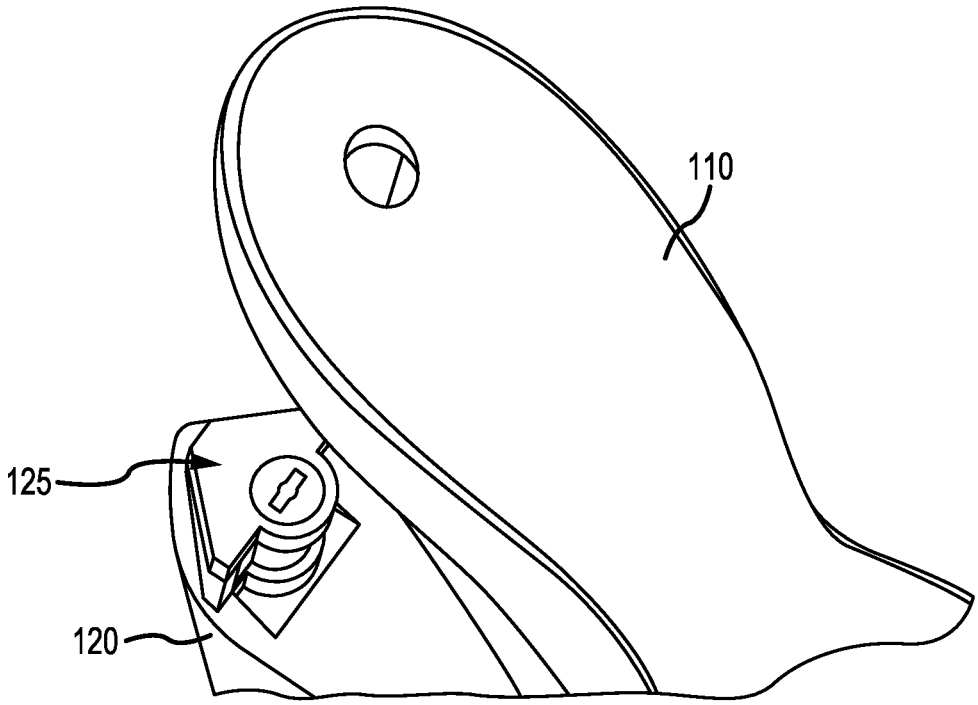
FIG. 4A is perspective view of an outsole separated from a sole, showing an attachment mechanism used for reversibly coupling the outsole to the sole, in accordance with various embodiments.
Figure 4B:
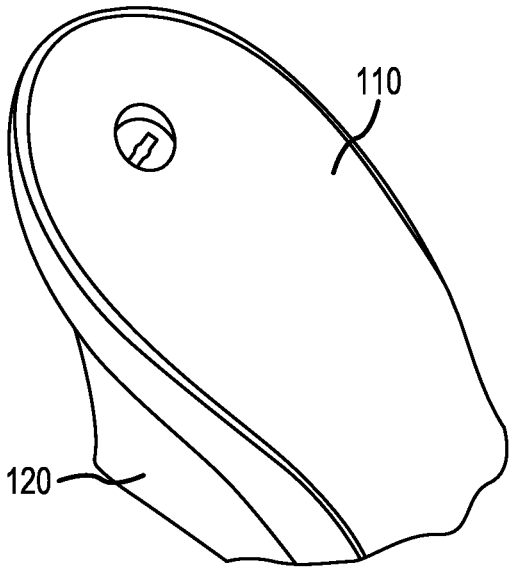
FIG. 4B is a perspective view of an attachment mechanism of a shoe in a released state, in accordance with various embodiments.
Figure 4C:
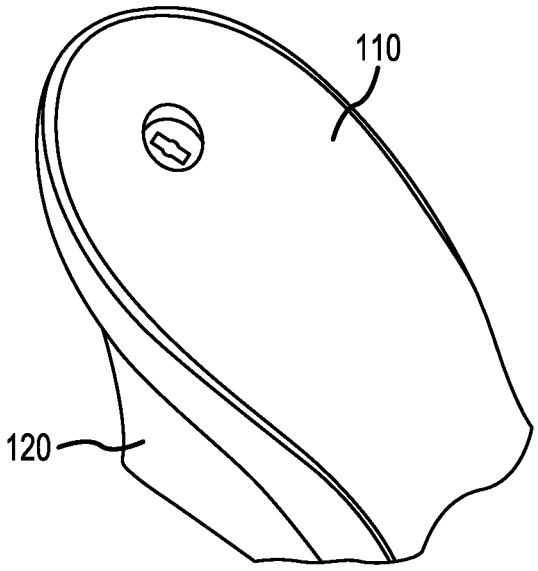
FIG. 4C is a perspective view of an attachment mechanism of a shoe in a locked state, in accordance with various embodiments.
Figure 5:
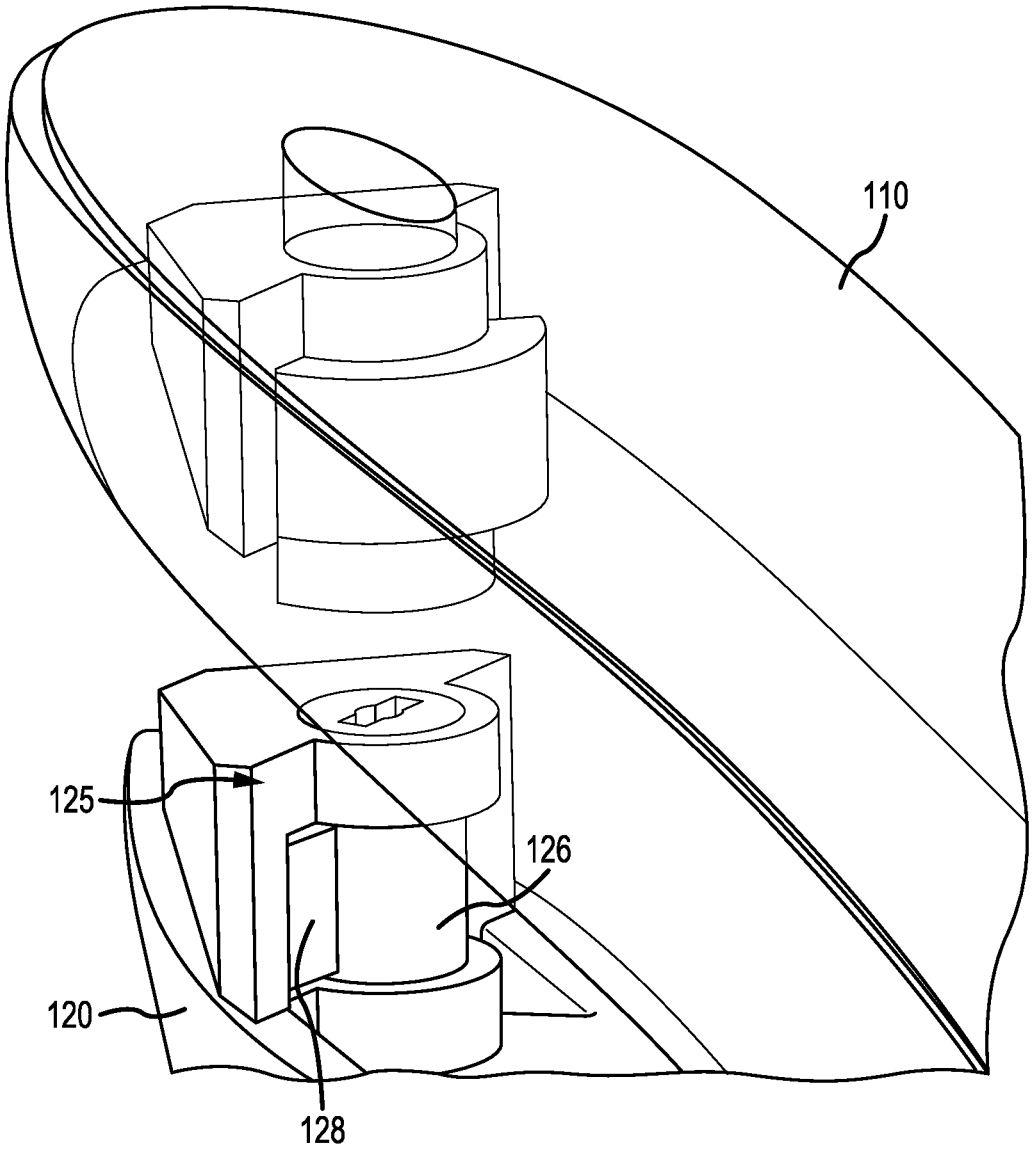
FIG. 5 is a perspective view of an outsole separated from a sole, showing an attachment mechanism used for reversibly coupling the outsole to the sole, in accordance with various embodiments.

In various embodiments, and with reference to FIGS. 4A, 4B, and 4C, the shoe 100 further includes an attachment mechanism generally disposed between a respective outsole and the sole 110 to enable reversible securement of the respective outsole to the sole 110. Said differently, the shoe 100 may include a rear attachment mechanism 125 configured to enable reversible securement of the rear outsole 120 to the rear portion of the sole 110 and a forward attachment mechanism 135 (FIG. 7) configured to enable reversible securement of the forward outsole 130 to the rear portion of the sole 110. These attachment mechanisms may be configured to be independently actuated between a locked state (FIG. 4C) and a released state (FIG. 4B). In the locked state, the outsole is prevented from detaching from the sole, while in the released state the outsole is allowed to be detached/separate from the sole. Although numerous details are included herein pertaining to the attachment mechanism having a specific structure, in various embodiments the shoe may have an attachment mechanism having a different structure suitable for the functionality and configurations disclosed herein.

In various embodiments, the sole 110 of the shoe 100 may include an aperture or other pass-through hole through which the user/wearer is able to see and access at least a portion of the attachment mechanism. Said differently, a portion of the attachment mechanism may be visible and/or accessible from above a top surface of the sole 110. For example, the rear attachment mechanism 125 may include a key feature (e.g., a slot or recess defined in a tip of a rotatable shaft of the attachment mechanism), and an actuation key 111 may be configured to engage the key feature (e.g., by inserting the actuation key 111 through the aforementioned aperture or pass-through hole) to rotate the shaft or to otherwise actuate the mechanism to switch between the locked state and the released state.

Figure 6B:
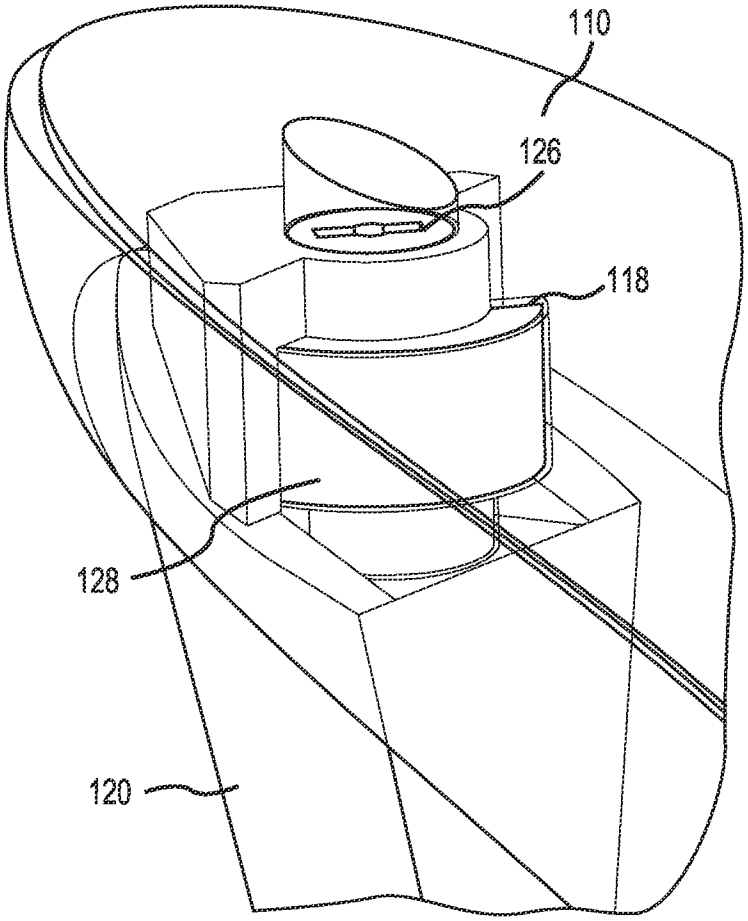
FIG. 6B is a perspective view of an attachment mechanism in a locked state, in accordance with various embodiments.
Figure 6A:
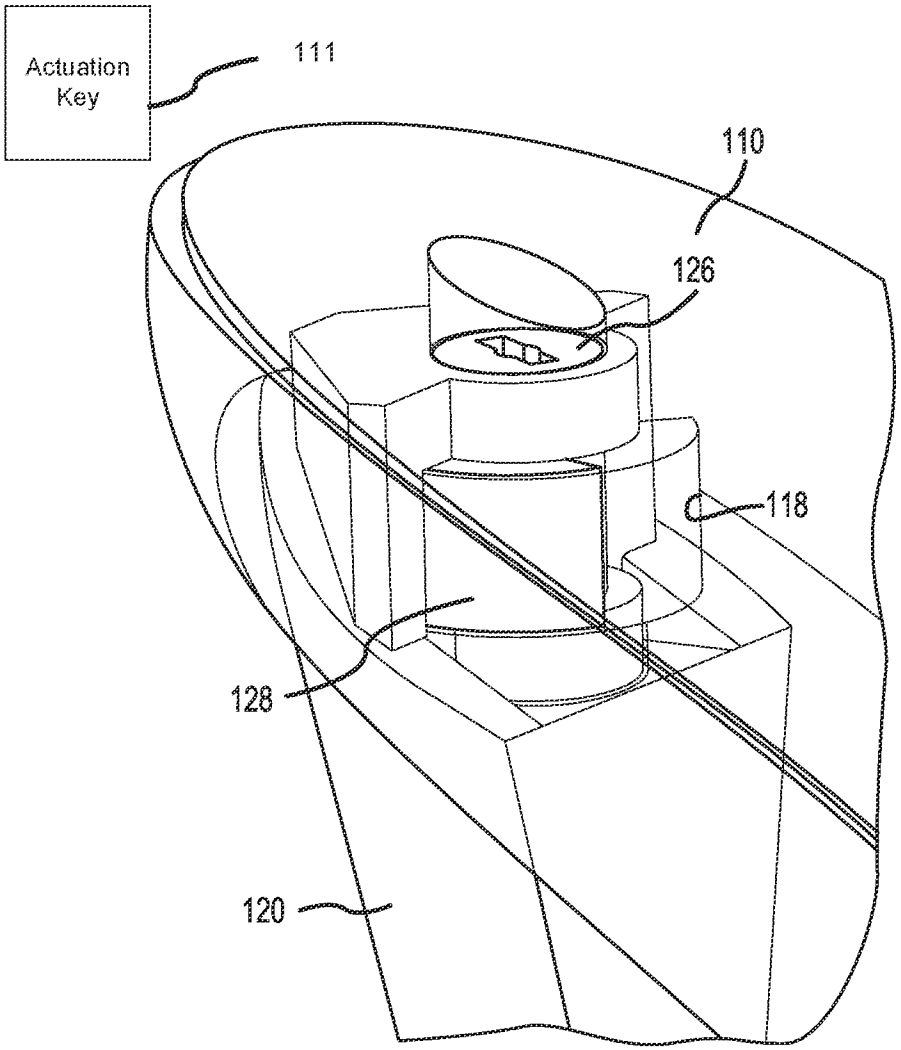
FIG. 6A is a perspective view of an attachment mechanism in a partially locked state (e.g., transitioning between a locked state and released state), in accordance with various embodiments.
Figure 7:
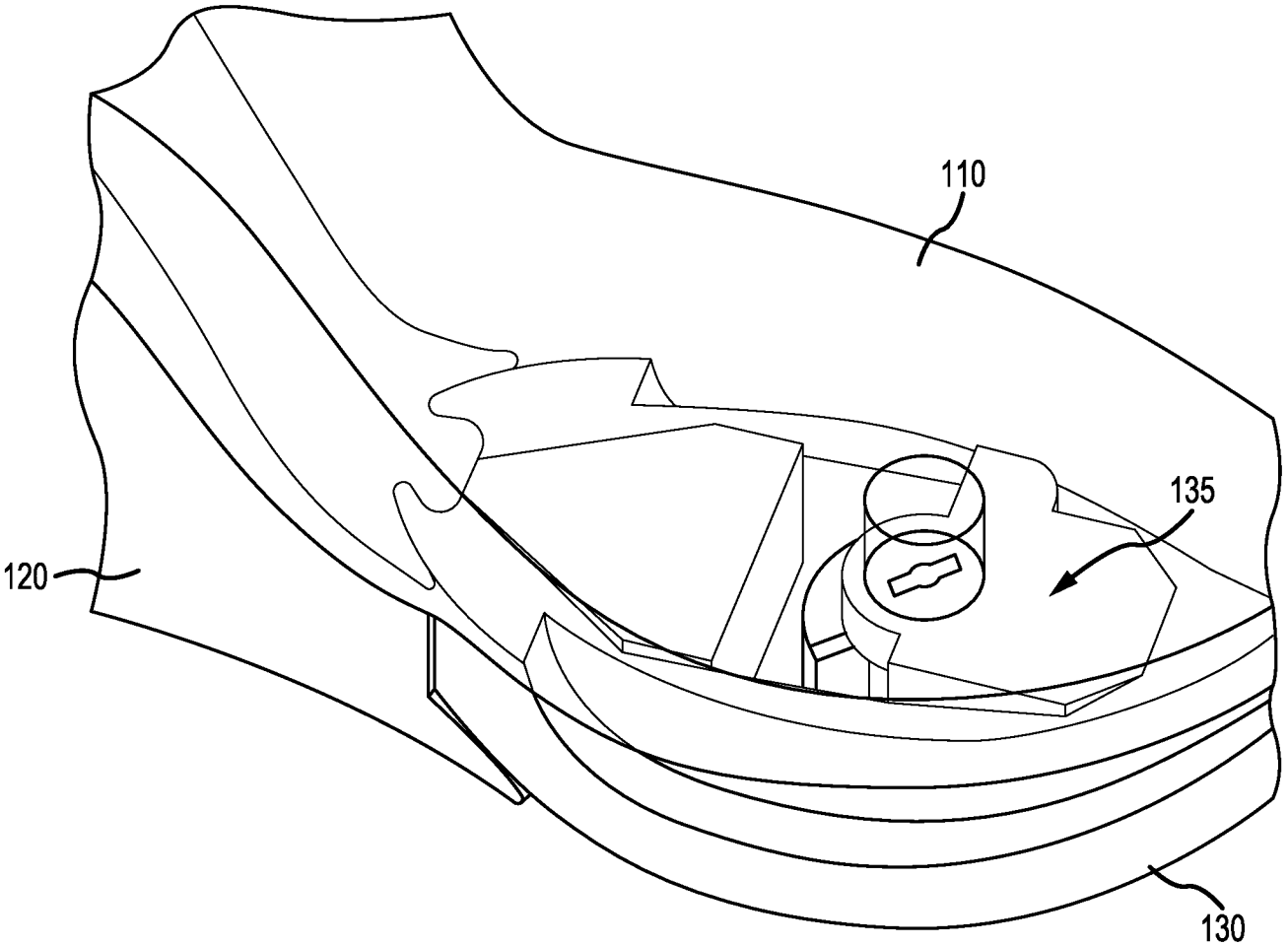
FIG. 7 is a perspective view of a forward attachment mechanism in a locked state retaining a forward outsole to a forward portion of a sole of a shoe, in accordance with various embodiments.

The attachment mechanism 125 may be integrated with the detachable outsole 120, or the attachment mechanism may be integrated with the sole and may be configured to interface with the outsole. In various embodiments, and with reference to FIGS. 5, 6A, and 6B, the attachment mechanism 125 includes a shaft 126 rotatably housed and supported in one of the rear outsole 120 and the rear portion of the sole 110. The shaft 126 comprises a flange section 128, which may be a unitary extension of the shaft 126, and the flange section may be configured to co-rotate with the shaft 126. The flange section 128 may be configured to engage the other of the rear outsole 120 and the rear portion of the sole 110 in the locked state, according to various embodiments. The flange section 128 may be a widened, thicker portion of the shaft 126, and by rotating the shaft 126 the flange section 128 may be rotated to be engaged against a shoulder or otherwise disposed within a corresponding structure or recess, thereby facilitating secure retention and attachment of the outsole to the sole in the locked state. For example, the sole may define a chamber 118, and in the locked state the flange section 128 of the shaft may be disposed in the chamber 118 to retain the rear outsole 120 connected to the rear portion of the sole 110. FIG. 6A, for example, shows the flange section 128 partially within the chamber 118, and thus FIG. 6A shows the attachment mechanism is a partially locked state, or shows the attachment mechanism transitioning between the locked state (FIG. 6B) and the released state. In various embodiments, in the released state, the shaft 126 is rotated such that the flange section 128 is not disposed in the chamber 118, thus allowing detachment of the rear outsole 120 from the rear portion of the sole 110.

Figure 8A:
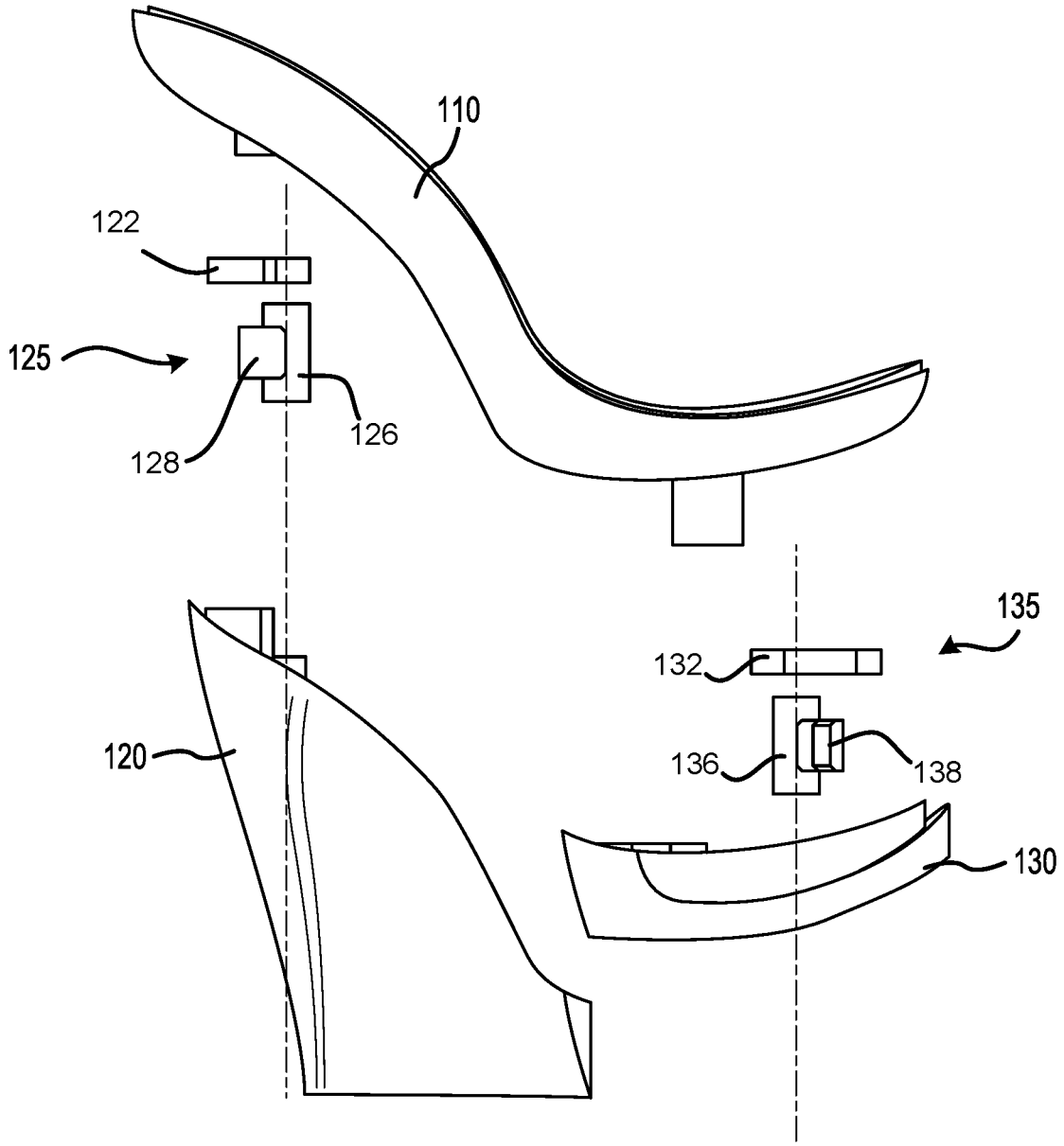
FIGS. 8A, 8B, 8C, and 8D are various views of components of an attachment mechanism, in accordance with various embodiments.
Figure 8B:
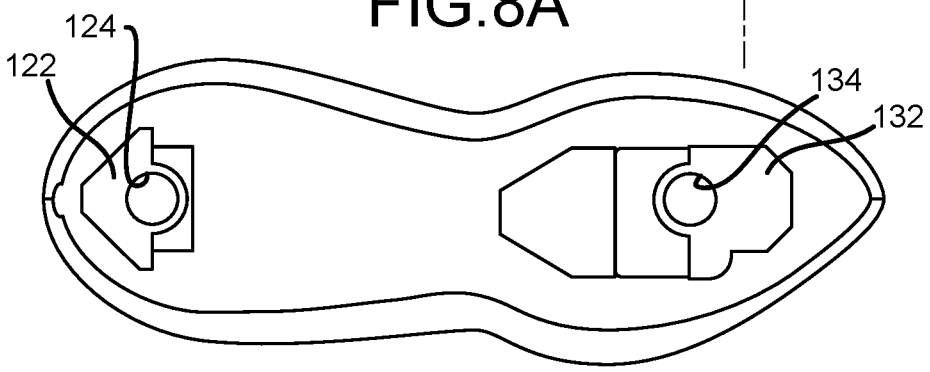
Figure 8D:
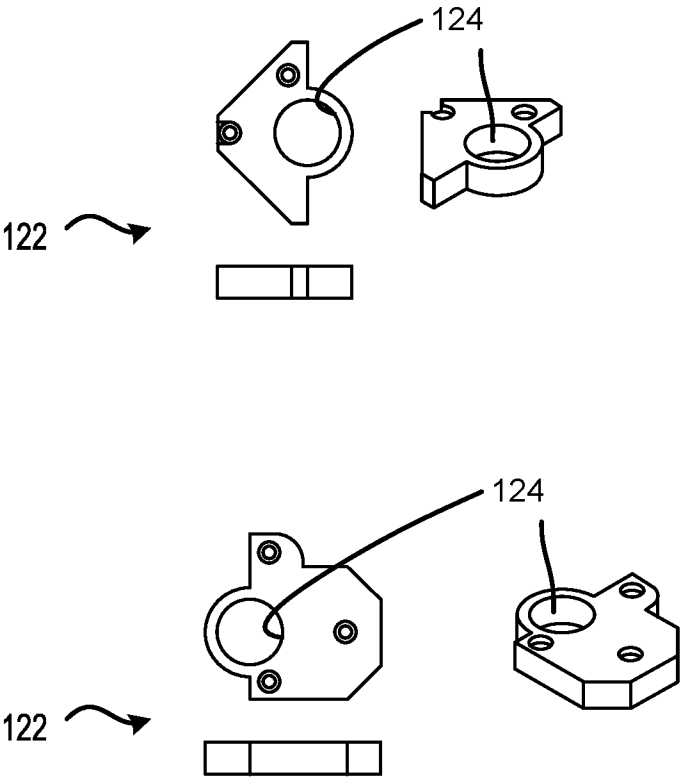
Figure 8C:
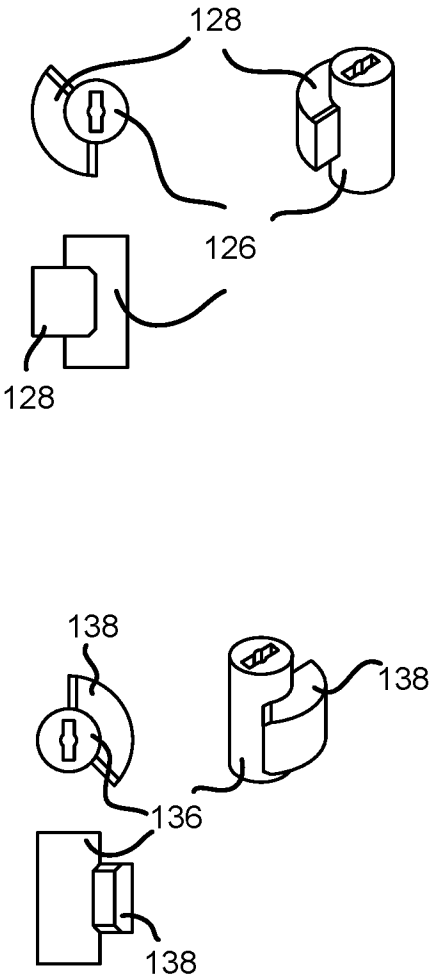

FIGS. 8A, 8B, 8C, and 8D show further details of the various components of the attachment mechanism described above with reference to FIGS. 5, 6A, 6B, and 7. More specifically, FIG. 8A is an exploded side view of a shoe, showing the various features and components of the attachment mechanisms 125, 135, according to various embodiments and FIG. 8B is a bottom view of the sole 110 showing mounting plates 122, 132 coupled to the sole 110. Further, FIG. 8C shows top, perspective, and side views of the respective shafts and flanges of the attachment mechanisms and FIG. 8D shows top, perspective, and side views of the respective mounting plates of the attachment mechanisms. In various embodiments, the attachment mechanism(s) 125, 135 include respective mounting plates 122, 132 affixed to the sole 110, and the shaft(s) 126, 136 of the attachment mechanisms may be respectively rotatably supported by the mounting plates 122, 132. Said differently, the mounting plates 122, 132 may define an aperture 124, 134 within which at least a portion of the shaft 126, 136 is housed.

Although numerous details are included herein pertaining to a shoe having two detachable outsoles, the present disclosure also provides a shoe having a single detachable outsole having the attachment mechanism(s) described above. Further, in various embodiments the shoe may include a single detachable outsole that may cover the entire bottom of the shoe, and may be attached/anchored at the two locations described above.

Benefits, other advantages, and solutions to problems have been described herein with regard to specific embodiments. However, the benefits, advantages, solutions to problems, and any elements that may cause any benefit, advantage, or solution to occur or become more pronounced are not to be construed as critical, required, or essential features or elements of the disclosure.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. No claim element is intended to invoke 35 U.S.C. 112(f) unless the element is expressly recited using the phrase "means for."

The scope of the disclosure is to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. Further, the term "plurality" can be defined as "at least two." As used herein, the phrase "at least one of", when used with a list of items, means different combinations of one or more of the listed items may be used and only one of the items in the list may be needed. The item may be a particular object, thing, or category. Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A, B, and C. In some cases, "at least one of item A, item B, and item C" may mean, for example, without limitation, two of item A, one of item B, and ten of item C; four of item B and seven of item C; or some other suitable combination.

All ranges and ratio limits disclosed herein may be combined. Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Different cross-hatching may be used throughout the figures to denote different parts but not necessarily to denote the same or different materials. Surface shading lines may be used throughout the figures to denote different parts or areas but not necessarily to denote the same or different materials. In some cases, reference coordinates may be specific to each figure. Furthermore, the connecting lines shown in the various figures contained herein are intended to represent exemplary functional relationships and/or physical couplings between the various elements. It should be noted that many alternative or additional functional relationships or physical connections may be present in a practical system.

Any reference to attached, fixed, connected or the like may include permanent, removable, temporary, partial, full and/or any other possible attachment option. Additionally, any reference to without contact (or similar phrases) may also include reduced contact or minimal contact. In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

The schematic flow chart diagrams included herein are generally set forth as logical flow chart diagrams. As such, the depicted order and labeled steps are indicative of one or more embodiments of the presented method. The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. Other steps and methods may be conceived that are equivalent in function, logic, or effect to one or more steps, or portions thereof, of the illustrated method.

Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown. Furthermore, no element, component, or method step in the present disclosure is intended to be dedicated to the public regardless of whether the element, component, or method step is explicitly recited in the claims.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A shoe comprising:

a sole configured to support a wearer's foot;

a forward outsole;

a rear outsole comprising an interlocking interface configured to interlock with the forward outsole;

wherein the forward outsole comprising a corresponding interlocking interface configured to engage with the rear outsole;

an actuation key;

a forward attachment mechanism integrated with the sole and the forward outsole, wherein the forward attachment mechanism is configured to enable reversible securement of the forward outsole to the sole with the actuation key; and a rear attachment mechanism integrated with the sole and the rear outsole, wherein the rear attachment mechanism is configured to enable reversible securement of the rear outsole to the sole with the actuation key, wherein the removable actuation key is configured for insertion into a first slot of the forward attachment mechanism and a second slot of the rear attachment mechanism.

2. The shoe of claim 1, wherein the sole comprises a rear portion and a forward portion, and wherein the rear portion of the sole is a heel portion of the sole and the forward portion of the sole is a toe portion of the sole.

3. The shoe of claim 1, wherein the rear outsole is configured to be detached independent of the forward outsole, and vice-versa.

4. The shoe of claim 1, wherein the interlocking interface of the rear outsole comprises one of a protrusion and a corresponding groove and the forward outsole comprises the other of the protrusion and the corresponding groove.

5. The shoe of claim 4, wherein the interlocking interface between the protrusion and the corresponding groove is configured to limit substantial movement between the rear outsole and the forward outsole to relative sliding motion along an axis of the interlocking interface.

6. The shoe of claim 1, wherein each of the rear attachment mechanism and the forward attachment mechanism is configured to be actuated between a locked state and released state.

7. The shoe of claim 6, wherein the rear attachment mechanism is configured to be actuated independent of the forward attachment mechanism.

8. The shoe of claim 2, wherein the rear attachment mechanism comprises a shaft rotatably housed and supported in one of the rear outsole and the rear portion of the sole, wherein the shaft comprises a flange section configured to engage the other of the rear outsole and the rear portion of the sole in the locked state.

9. The shoe of claim 8, wherein the other of the rear outsole and the rear portion of the sole defines a chamber, wherein in the locked state the flange section of the shaft is disposed in the chamber to retain the rear outsole connected to the rear portion of the sole.

10. The shoe of claim 9, wherein the sole is an integral sole.

* * * * *